US006409848B1

(12) United States Patent
Bewlay et al.

(10) Patent No.: US 6,409,848 B1
(45) Date of Patent: Jun. 25, 2002

(54) CREEP RESISTANT NB-SILICIDE BASED MULTIPHASE COMPOSITES

(75) Inventors: Bernard Patrick Bewlay; Melvin Robert Jackson, both of Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/651,574

(22) Filed: Aug. 24, 2000

(51) Int. Cl.[7] ..... C22C 27/02
(52) U.S. Cl. ..... 148/422; 420/425; 420/426
(58) Field of Search ..... 148/422; 420/425, 420/426

(56) References Cited

U.S. PATENT DOCUMENTS

| | | | |
|---|---|---|---|
| 5,393,487 | A | 2/1995 | Matway et al. |
| 5,741,376 | A | 4/1998 | Subramanian et al. |
| 5,833,773 | A | 11/1998 | Bewlay et al. |
| 5,932,033 | A | 8/1999 | Jackson et al. |
| 5,942,055 | A | 8/1999 | Jackson et al. |

OTHER PUBLICATIONS

M. R. Jackson, et al, High–Temperature Refractory Metal–Intermetallic Composites, *Journal of Metals*, Jan., 1996.

B. P. Bewlay, et al., Refractory Metal–Intermetallic In–Situ Composites for Aircraft Engines, Reprinted from *JOM*, vol. 49, No. 8, Aug., 1997, pp. 44–45; p. 67.

B. P. Bewlay, et al., Evidence for the Existence of $Hf_5Si_3$, *Journal of Phase Equilibria*, vol. 20, No. 2, 1999.

B. P. Bewlay, et al., Processing High–Temperature Refractory–Metal Silicide In–Situ Composites, Reprinted from *JOM*, vol. 51, No. 4, Apr., 1999, pp. 32–36.

P. R. Subramanian, et al., Compressive Creep Bahavior of $Nb_5Si_3$, *Scripta Metallurgica et Materialia*, vol. 32, No. 8, pp. 1227–1232, 1995.

B. P. Bewlay, et al., The Nb–Ti–Si Ternary Phase Diagram: Evaluation of Liquid–Solid Phase Equilibria in Nb–and Ti–Rich Alloys, *Journal of Phase Equilibria*, vol. 18, No. 3, 1997.

B. P. Bewlay, et al, The Nb–Hf–Si Ternary phase Diagram: Liquid–Solid Phase Equilibria in Nb–0 and Hf–rich Alloys, *z. Metallkd*, 90, 1999.

B. P. Bewlay, et al., The Nb–Ti–Si Ternary Phase Diagram: Determination of Solid–State Phase Equilibria in Nb–and Ti–Rich Alloys, *Journal of Phase Equilibria*, vol. 19, No. 6, 1998.

*Primary Examiner*—Deborah Yee
(74) *Attorney, Agent, or Firm*—Paul J. Diconza; Donald S. Ingraham

(57) ABSTRACT

A niobium-based silicide composite exhibiting creep resistance at temperatures equal to or greater than 1150° C. The niobium-based silicide composite comprises at least silicon (Si), hafnium (Hf), titanium (Ti), and niobium (Nb). A concentration ratio of Nb:(Hf+Ti) is equal to or greater than about 1.4. The niobium-based silicide composite exhibits a creep rate less than about $5\times10^{-8}s^{-1}$ at temperatures up to about 1200° C. and at a stress of about 200 MPa.

33 Claims, 3 Drawing Sheets

CREEP RESISTANT NB-SILICIDE BASED MULTIPHASE COMPOSITES

This invention was made with Government support under Contract No. F49620-96-C-0022 awarded by the Department of Defense—United States Air Force and therefore, the Government has certain rights in the invention.

BACKGROUND OF THE INVENTION

The invention relates to multiphase Nb-silicide in-situ composites having improved creep performance. In particular, the invention relates to multiphase Nb-silicide based composites having a certain ratio of niobium (Nb), hafnium (Hf), and titanium (Ti).

Traditionally, turbine components have been often formed from nickel-(Ni) based superalloys materials. These Ni-based superalloys have been used for turbines and turbine components, such as but not limited to, jet engine turbines, land-based turbines, marine-based turbines, and other high temperature turbine environments. The applications of these Ni-based superalloy turbine components may be limited by the high temperatures associated with turbine component operations. Surface temperatures during operation of turbine components can approach temperatures up to and above 1150° C., which are approximately 85% of the melting temperatures of the Ni-based superalloy. Therefore, these temperatures can limit the applications of Ni-based superalloys as the high temperatures may adversely influence the Ni-based superalloy's strength, oxidation resistance, and creep resistance. Further, other intrinsic Ni-based superalloy properties at these high temperatures, such as but not limited to, fracture toughness, high-temperature strength, oxidation resistance, and other mechanical properties, may prevent further applications.

In order to overcome the above-noted deficiencies of the Ni-based superalloys, niobium-(Nb) and molybdenum-(Mo) modified Nb-silicide based composite materials have been investigated for turbine component applications. Niobium has been used to form refractory metal intermetallic composites (hereinafter referred to as "RMIC"s), which include, but are not limited to, Nb-based refractory metal intermetallic composites. RMICs, such as but not limited to Nb-silicide based composites, possess potentially high operating temperatures, for example, but not limited to, those temperatures encountered in turbine component applications. These RMICs have higher melting temperatures that Ni-based superalloys, and thus may find beneficial applications in turbine components. For example, some RMICs may have melting temperatures in excess of 1700° C., which would be desirable in a turbine component application. See M. R. Jackson et al., "High-Temperature Refractory Metal-Intermetallic Composites", Journal of Materials, January 1996 (pp. 39–44).

RMIC mechanical properties, such as, fracture toughness, high-temperature strength, and oxidation resistance are also enhanced compared to Ni-based superalloys. However, Nb-based refractory metal intermetallic composites may possess poor creep resistance at elevated temperatures, which would be undesirable in turbine components. This creep performance may be due to the existence of an additional hP16 hexagonal phase, which is present in Nb-based composites.

Thus, there is a need for improved high temperature alloys for turbine component applications. Therefore, another need exists to provide a Nb-based material for high temperature applications, in which the Nb-based material can find use in high temperature applications with enhanced creep resistance.

BRIEF SUMMARY OF THE INVENTION

One aspect of the present invention provides a multiphase niobium-based silicide composite that exhibits creep resistance at temperatures equal to or greater than 1150° C. The niobium-based silicide composite comprises at least silicon (Si) hafnium (Hf), titanium (Ti), and niobium (Nb). The concentration ratio of Nb:(Hf+Ti) is equal to or greater than about 1.4 and the niobium-based silicide composite comprises at least silicon (Si), hafnium (Hf), titanium (Ti), and niobium (Nb), wherein a concentration ratio of Nb:(Hf+Ti) is equal to or greater than about 1.4 and the niobium-based silicide composite exhibits a creep rate less than about $5\times10^{-8}s^{-1}$ at temperatures up to about 1200° C. and at a stress of about 200 MPa.

Another aspect of the invention provides a multiphase niobium-based silicide composite that exhibits high temperature creep resistance at temperatures up to about 1200° C. The niobium-based silicide composite comprises, in atomic percent, up to about 25% titanium (Ti), silicon (Si) in a range from about 10% to about 22%, at least about 4% hafnium (Hf), and a balance niobium (Nb).

A further aspect of the invention provides a method for forming a multiphase niobium-based silicide composite. The composite exhibits creep resistance at elevated temperatures. The method of forming the composite comprises providing silicon (Si), hafnium (Hf), titanium (Ti) and niobium (Nb), and optionally tantalum (Ta), germanium (Ge), iron (Fe), boron (B), molybdenum (Mo), aluminum (Al), chromium (Cr), and tungsten (W). A ratio of Nb:(Hf+Ti) is equal to or greater than about 1.4.

Another aspect of the invention provides a turbine component comprising, in atomic percent, 7.5% hafnium (Hf), 16% silicon (Si), 21% titanium (Ti), and a balance niobium (Nb).

Still another aspect of the invention provides a turbine component comprising, in atomic percent, 8% hafnium (Hf), 16% silicon (Si), 21% titanium (Ti), and a balance niobium (Nb).

In a further aspect of the invention provides a turbine component comprising, in atomic percent, 3% molybdenum (Mo), 8% hafnium (Hf), 16% silicon (Si), 25% titanium (Ti), and a balance niobium (Nb).

An additional aspect of the invention provides a turbine component, in atomic percent, 9% molybdenum (Mo), 8% hafnium (Hf), 16% silicon (Si), 25% titanium (Ti), and a balance niobium (Nb).

BRIEF DESCRIPTION OF THE DRAWINGS

Other features and advantages of the invention will become apparent from the following description of the invention, which refers to the accompanying drawings, wherein.

DETAILED DESCRIPTION OF THE INVENTION

Figure 1:
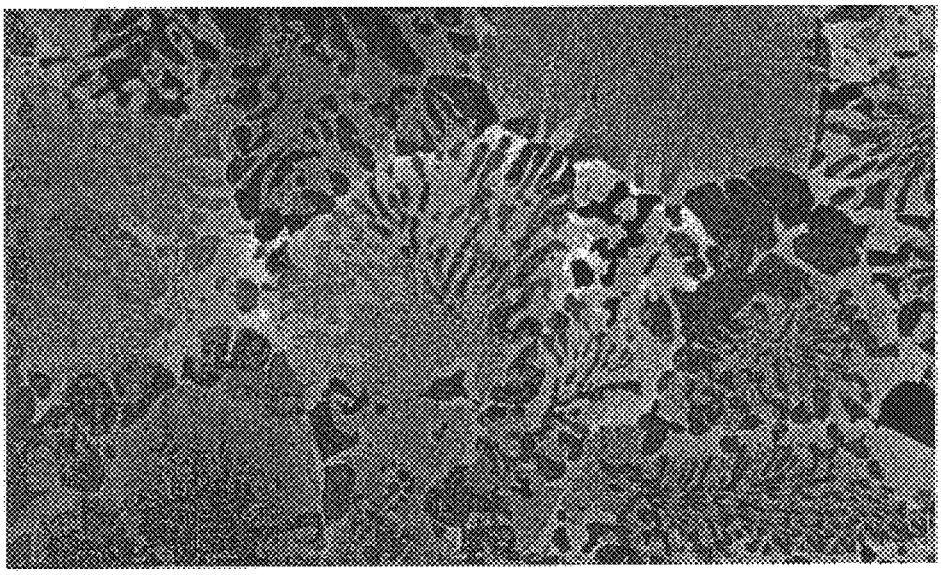
FIG. 1 illustrates the microstructure of a composite directionally solidified from a quaternary Nb—Hf—Ti—Si alloy having a Nb: (Hf+Ti) ratio greater than about 1.4.

Niobium (Nb)-based refractory metal-intermetallic composites, as embodied by the invention, can be used in high temperature applications. These high temperature applications comprise, but are not limited to, applications in turbines, such as in components of aeronautical turbines, land-based turbines, jet engine turbines, marine turbines, and similar turbines (hereafter referred to as "turbine components"). The turbine component may comprise, but is not limited to, a vane, blade, bucket, and stator. The following description of the invention, will refer to a turbine component in general. This description is not intended to limit the invention in any manner, and the scope of the invention comprises any turbine component.

Multiphase Nb-silicide based composites are typically developed from binary alloys, which include at least niobium (Nb) and silicon (Si). Nb-silicide based composites can enhance high-temperature oxidation performance and fracture toughness in a turbine component. Further, the Nb-silicide based composite can provide the turbine component sufficient high-temperature strength and stiffness, for applications at temperatures equal to and above about 1150° C., which are temperatures often encountered in turbine component applications. The term multiphase means that the composite comprises at least two or more phases. The multiphase Nb-silicide based composite, as embodied by the invention, will be referred to hereinafter as a "Nb-silicide based composite".

A Nb-silicide based composite, as embodied by the invention, can comprise other constituents to modify various mechanical and thermal properties. The Nb-silicide based composite can be modified by adding at least one of: hafnium (Hf), titanium (Ti), molybdenum (Mo), boron (B), geranium (Ge), iron (Fe), tungsten (W), chromium (Cr), tantalum (Ta), tin (Sn), and aluminum (Al) (hereinafter collectively referred to as "modifiers") to the Nb-silicide based composite. These modifiers can enhance mechanical and thermal properties of the Nb-silicide based composite at high-temperatures, such as, but not limited to, oxidation resistance, room temperature toughness, and strength. Further, the Nb-silicide based composite, as embodied by the invention, can comprise at least one of niobium silicides, such as, but not limited to, $Nb_3Si$ and $Nb_5Si_3$, each of which can be toughened by adding niobium (Nb).

The Nb-silicide based composite, as embodied by the invention, comprises amounts of Ti and Hf that are controlled to maintain high-temperature operational creep performance of the Nb-silicide based composite. For example, a Nb:(Ti+Hf) concentration ratio is in a range from about 1.4 to about 2.5, and often the Nb:(Ti+Hf) concentration ratio is about 1.4, to allow for desirable creep performances at creep rates of about 140 MPa and above. Further, Nb amount in the Nb-silicide based composite can be maintained at a certain level, thus maintaining the high-temperature creep performance in the Nb-silicide based composite, as embodied by the invention. Although lower Nb:(Hf+Ti) concentration ratios may be desirable for oxidation resistance characteristics of the Nb-silicide based composite, lower concentration s of Nb:(Hf+Ti) may have an adverse effect on creep resistance.

The amounts of the modifiers of the Nb-silicide based composite, as embodied by the invention, can be provided within certain ranges. For example, the niobium-based silicide composite may comprise, in atomic percent, up to about 10% tantalum (Ta), hafnium (Hf) in a range from about 2% to about 8% such as but not limited to about 4%, silicon in a range from about 10% to about 22%, up to 25% titanium (Ti), up to about 10% germanium (Ge), up to about 5% tin (Sn), up to about 6% iron (Fe), up to about 8% boron (H), up to about 3% molybdenum (Mo), up to about 5% aluminum (Al), and one of chromium (Cr) up to about 15% and tungsten (W) up to about 5%, silicon (Si) in a range from about 10% to about 22%, an d a balance niobium (Nb). The term "up to" means that the amount of the modifier may be zero, in which none of that modifier is provided. Further, the term "up to" means that the amount of the modifier may be a trace amount, in which small amounts of the modifier are provided, for example, amounts less than or equal to about 1% by atomic. In the description of the invention, the values are provided in approximate terms, unless specifically indicated.

The Nb-silicide based composites, as embodied by the invention, were investigated for their material characteristics, including but not limited to, creep resistance and creep rates. The investigation is conducted by preparing Nb-silicide based composite samples (hereinafter "sample") using cold crucible Czochrolski directional solidification, which followed triple melting of high purity elemental starting charges (hereinafter "starting charges"). The term "high purity" means that the starting charges were greater than about 99.99% pure. The starting charges were induction melted in a segmented water-cooled copper crucible. A Nb—16Si composition was used as a base binary alloy composition from which the higher order alloys were derived, as discussed hereinafter.

Various Nb-silicide based composite samples were prepared to determine their material characteristics. All concentrations are given in approximate atom percent unless otherwise specified. Some data for the Nb-silicide based composite samples are set forth in Table 1, which includes creep rates.

TABLE 1

| Composition | Major Constituent Phases | Nb (Hf + Ti) Ratio | 140 MPa Creep Rate ($s^{-1}$) | 210 MPa Creep Rate($s^{-1}$) | 280 MPa Creep Rate($s^{-1}$) |
|---|---|---|---|---|---|
| Nb-16Si | (Nb), $Nb_3Si$ | — | $1.5 \times 10^{-8}$ | $4.9 \times 10^{-8}$ | Failed |
| Nb-7.5Hf-16Si | (Nb), $Nb_3Si$ | 10.2 | $2.3 \times 10^{-8}$ | $4.0 \times 10^{-8}$ | $4.8 \times 10^{-8}$ |
| Nb-7.5Hf-21Ti-16Si | (Nb), $Nb_3Si$ | 1.95 | $2.1 \times 10^{-8}$ | $3.2 \times 10^{-8}$ | $1.2 \times 10^{-7}$ |
| Nb-12.5Hf-21Ti-16Si | (Nb), $Nb_3Si$ | 1.51 | $5.5 \times 10^{-8}$ | $4.8 \times 10^{-6}$ | Failed |

TABLE 1-continued

| Composition | Major Constituent Phases | Nb (Hf + Ti) Ratio | 140 MPa Creep Rate ($s^{-1}$) | 210 MPa Creep Rate($s^{-1}$) | 280 MPa Creep Rate($s^{-1}$) |
|---|---|---|---|---|---|
| Nb-12.5Hf-33Ti-16Si | (Nb), $Nb_3Si$ $(Ti, Hf)_5Si_3$ | 0.85 | $3.8 \times 10^{-5}$ | Failed | |

The compression and tension creep tests that resulted in the data in Table 1 were performed at temperatures of about 1200° C. Further, the compression and tension creep tests were conducted at stress level ranges listed in Table 1. The Nb-silicide based composites were formed into cylindrical samples, which were about 7.6 mm in diameter and about 15.3 mm in length. The Nb-silicide based composite samples were machined, for example by EDM and then centerless ground, to their final dimensions.

In each of the investigative tests, the sample was placed between two 18.7 mm diameter silicon nitride platens, which prevented breakage of graphite rams used to apply forces thereto. Additionally, essentially pure niobium foil was placed at interfaces between the platens and sample to prevent sample contamination or reaction with the platens. The creep rate tests included placing a sample between the platens.

A furnace was heated to a desired temperature, the sample was then loaded to the first stress level of 35 MPa, and held at that level for 24 hours. The creep rate was determined from the slope of the strain-time data. At the end of 24 hours, the sample dimensions were determined. The load was increased to the next desired stress level.

Table 1 shows the creep rates of binary Nb—16Si, ternary Nb—7.5Hf—16Si, and a range of quaternary Nb—Hf—Ti—Si alloys to illustrate allowable Hf and Ti concentrations for a Nb-silicide based composite, as embodied by the invention. The compositions were modified by varying the Nb:(Hf+Ti) ratio. The secondary creep rates were essentially similar, for example the rates at about 1200° C. and at stresses up to about 210 MPa were essentially similar (except for Nb—12.5Hf—33Ti—16Si). However, at 280 MPa the creep rate of the binary and the quaternary Nb—12.5Hf—21Ti—16Si alloy led to the failure of the samples, while the Nb—7.5Hf—16Si had a creep rate less than about $5.0 \times 10^{-8} s^{-1}$.

The data of Table 1 indicates that addition of Hf at low levels can provide reduced creep rates and increased creep resistance. Also, the data indicates that there are Ti and Hf concentrations above which creep performance of the Nb-silicide based composite is degraded. These concentration levels can be described by the Nb:(Hf+Ti) concentration ratio. The data in Table 1 indicates that above specific Ti and Hf concentrations, a creep rate may exceed a desired creep rate of $3 \times 10^{-8} s^{-1}$, which corresponds to a creep strain of 1% in 100 hours with minimal primary creep.

Further, with higher Ti concentrations, such as in Nb—7.5Hf—33Ti—16Si at stress levels of 140 MPa and above, creep rates are all higher than a desired creep rate, which is less than $3 \times 10^{-8} s^{-1}$. Similarly, higher Hf concentrations, such as in Nb—12.5Hf—21Ti—16Si at creep rates of 140 MPa and above, the creep rates are all higher than the desired creep rate. With high Hf and Ti concentrations, such as in Nb—12.5Hf—33Ti—16Si at creep rates of 140 MPa and above, the creep rates are higher than the required creep rates. Furthermore, while higher Ti concentrations may be desirable for oxidation resistance, the higher Ti concentrations may be deleterious to creep performance, thus a balance of the material characteristics and Ti concentration is desirable. At Nb:(Hf+Ti) concentration ratios less than 1.5, the creep performance is degraded beyond acceptable levels for stresses of 140 MPa and above.

Analysis of a sample's microstructural constituent phases in which the sample comprises high Hf and Ti concentrations indicates that at Nb:(Hf+Ti) concentration ratios less than about 1, a third phase, the hexagonal phase, hP16, is stabilized in these Nb-silicide based composites. The hP16 is a hexagonal close packed complex crystal structure with 16 atoms per unit cell. The presence of the hP16 phase can be estimated by metallographic methods using sections of the sample. It is believed that the hP16 hexagonal phase can lead to the results as listed in Table 1.

FIG. 1 illustrates a microstructure of a Nb-silicide based composite directionally solidified from a quaternary Nb—Hf—Ti—Si alloy with a Nb:(Hf+Ti) concentration ratio greater than 1.4. These quaternary alloy Nb-silicide based composites comprising Nb:(Hf+Ti) concentration ratios greater than 1.4 possess only Nb and $Nb_3Si$ phases, as shown in FIG. 1. In FIG. 1, the dark area is Nb and the light area is $Nb_3Si$. It appears that if the hP16 phase exists at volume fractions greater than approximately 5%, the creep performance of the Nb-silicide based composite is substantially degraded, for example as observed in Nb—12.5Hf—33Ti—16Si. Thus, for hypoeutectic Nb-Si alloys, the ratio above which the Nb: (Hf+Ti) concentration ratio should be maintained for desirable creep performance is approximately 1.4.

Nb-silicide based composites of quaternary Nb—Hf—Ti—Si were modified with molybdenum to further illustrate Nb-silicide based composite characteristics. Table 2 lists data including creep rates of the Mo-modified Nb-silicide based composite alloys with Nb-silicide based composites including a base Nb—16Si, Nb—7.5Hf—16Si, and Nb—8Hf—25Ti—16Si composites at 1200° C. The samples listed in Table 2 were prepared in a manner similar to those summarized in Table 1, in which the Nb-silicide based composite samples were directionally solidified and compression creep tested.

TABLE 2

| Composition | Major Constituent Phases | NB: (Hf + Ti) Ratio | 70 MPa Creep Rate($s^{-1}$) | 140 MPa Creep Rate($s^{-1}$) | 210 MPa Creep Rate($s^{-1}$) |
|---|---|---|---|---|---|
| Nb-16Si | (Nb), $Nb_3Si$ | — | $1.7 \times 10^{-9}$ | $1.5 \times 10^{-8}$ | $4.9 \times 10^{-8}$ |
| Nb-7.5Hf-16Si | (Nb), $Nb_3Si$ | 10.2 | — | $2.3 \times 10^{-8}$ | $4.0 \times 10^{-8}$ |

TABLE 2-continued

| Composition | Major Constituent Phases | NB: (Hf + Ti) Ratio | 70 MPa Creep Rate($s^{-1}$) | 140 MPa Creep Rate($s^{-1}$) | 210 MPa Creep Rate($s^{-1}$) |
|---|---|---|---|---|---|
| Nb-8Hf-25Ti-16Si | (Nb), $Nb_3Si$ | 1.56 | $6.3 \times 10^{-9}$ | $1.2 \times 10^{-8}$ | $8.0 \times 10^{-8}$ |
| Nb-3Mo-8Hf-25Ti- 16Si | (Nb), $Nb_3Si$ | 1.46 | $1.4 \times 10^{-8}$ | $2.5 \times 10^{-8}$ | $6.4 \times 10^{-8}$ |
| Nb-9Mo-8Hf-25Ti-16Si | (Nb), $Nb_3Si$ $(Ti,Hf)_5Si_3$ | 1.27 | $2.6 \times 10^{-8}$ | $2.2 \times 10^{-7}$ | $4.5 \times 10^{-6}$ |
| Nb-8Hf-24Ti-2A1-2Cr-16Si | (Nb), $Nb_3Si$ $(Ti,Hf)_5Si_3$ | 1.50 | $9.1 \times 10^{-8}$ | Failed | — |

The results of Table 2 indicate that creep rates increase with an increasing Mo concentration. At a creep rate of about 280 MPa, the Mo-modified samples failed without establishing a steady state. The Nb:(Hf+Ti) concentration ratio for the Nb-silicide based composite alloy comprising 9Mo was about 1.27. The creep rate change can be associated with a change in both the constituent phases and phase morphology in the Nb-silicide based composites.

Figure 2:
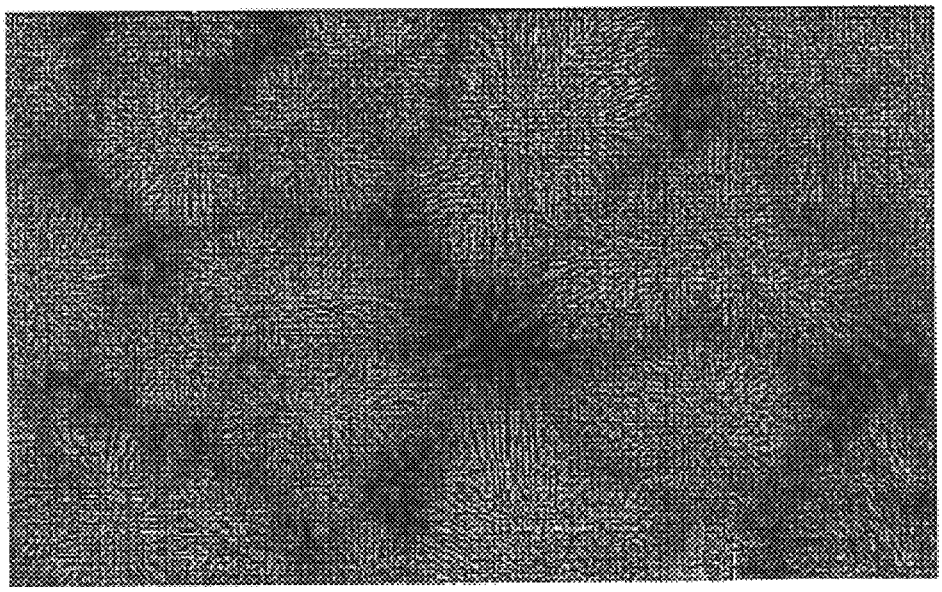
FIG. 2 is a backscatter electron image (BEI) of a transverse section of a Nb—9Mo—22Ti—8Hf—16Si alloy with a Nb:(Hf+Ti) ratio of about 1.5.

For example, FIG. 2 is a backscatter electron image (BEI) of a transverse section of a Nb—9Mo—25Ti—8Hf—16Si alloy, as embodied by the invention. The Mo-modified Nb-silicide based composite possesses a microstructure including fine-scale two-phase eutectic cells of body-centered cubic (bcc) (Nb), and hPl6 ((Ti, Hf)$_5$Si$_3$) type phases. The Mo-modified Nb-silicide based composite with 3% Mo possesses a microstructure with large-scale bcc (Nb), and $Nb_3Si$, type phases.

Similar Nb-silicide based composite behavior is also evident in Nb—8Hf—24Ti—2Al—2Cr—16Si that has a Nb:(Hf+Ti) concentration ratio of about 1.5. In this Nb-silicide based composite, as embodied by the invention, the creep rates at 1200° C. and stresses greater than about 70 MPa were high and led to premature failure of the sample. The Nb-silicide based composite could not support steady-state creep, and its microstructure was rapidly altered from primary to tertiary creep regime, and failed prematurely.

The creep data indicates that the Nb:(Hf+Ti) concentration ratio should be maintained less than 5, and a Ti concentration should be kept below 25%. At high Nb:(Hf+Ti) concentration ratios, hP16 $Ti_5Si_3$ type silicide can be stabilized instead of tI32 $Nb_5Si_3$ type or tP32 $Nb_3Si$-type silicides. These silicides have higher melting temperatures than either the $Ti_5Si_3$ or the $Hf_5Si3$, and can lead to enhanced creep resistance in Nb-silicide based composites. The creep performance can be sensitive to changes in the constituent phases of the Nb-silicide based composite, and an intrinsic performance of the silicide or the (Nb). The creep rate also indicates that a $(Ti,Hf)_5Si_3$ phase is detrimental to creep performance, for example if the phase's [0001] direction is aligned with a loading axis of the creep sample or structural component. Creep deformation in the Nb-silicide based composites was observed to occur by shear band formation in large-scale $(Ti,Hf)_5Si_3$ dendrites. High Nb:(Hf+Ti) concentration ratios can also reduce intrinsic creep performance of a tetragonal silicide.

Figure 3:
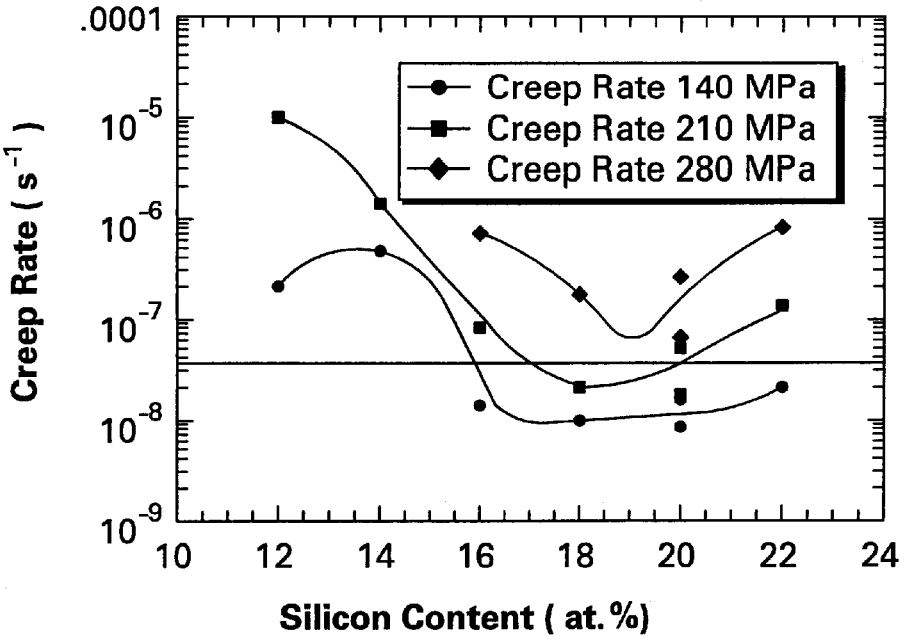
FIG. 3 is a plot of creep rate as a function of the percentage of silicon in an alloy composition, as embodied by the invention.
Figure 4:
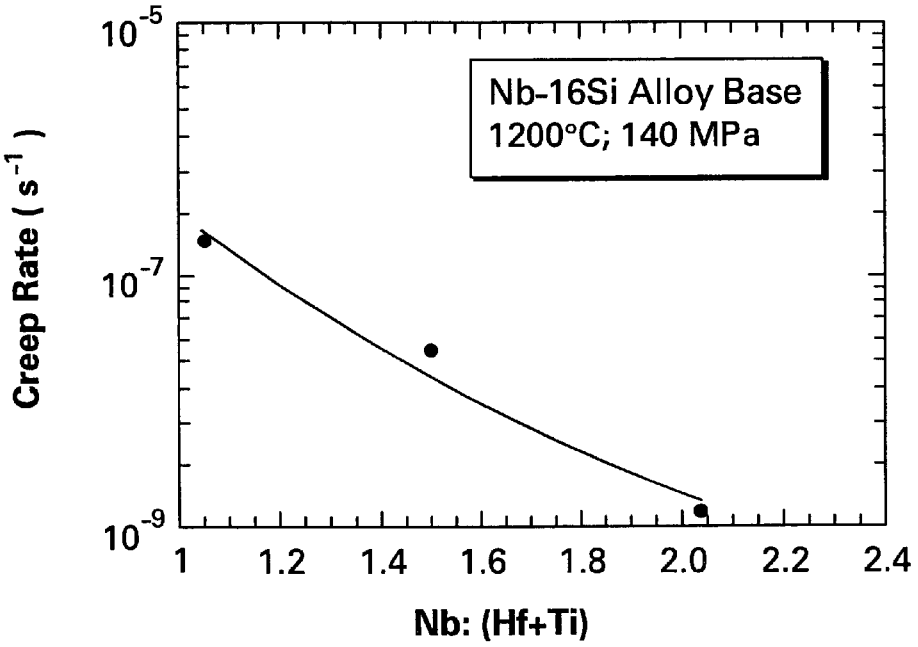
FIGS. 4–6 are plots of creep rate as a function of the Nb:(Hf+Ti) ratio in a Nb—16Si alloy of a series of Hf and Ti concentrations in alloys, as embodied by the invention, at a plurality of stresses.
Figure 5:
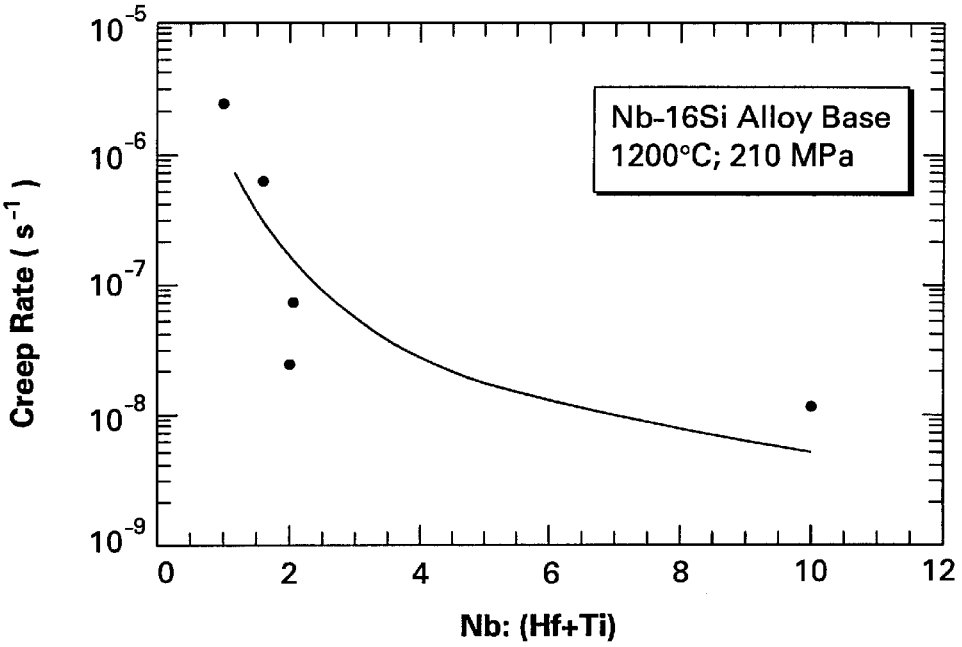
Figure 6:
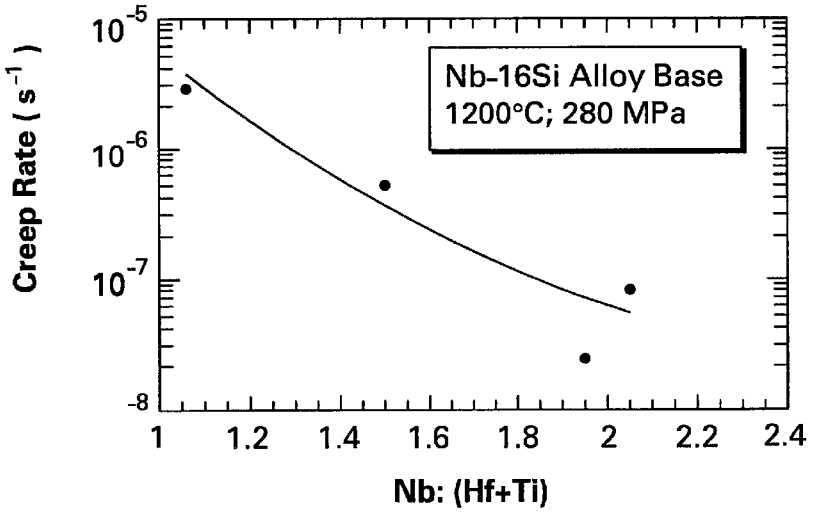

FIG. 3 illustrates creep rate as a function of percent of silicon in a base alloy. Low creep rates occur at 18% Si for any given stress. FIG. 4 illustrates a plot of creep rate versus Nb:(Hf+Ti) for a Nb—16Si alloy base at 1200° C. and 140 MPa and illustrates the reduction in creep rate as the Nb:(Hf+Ti) concentration ratio is increased. Above a concentration ratio of 3, the creep rate is no longer decreased, and there may be no further creep benefits. Further, FIG. 5 is a plot of creep rate versus Nb:(Hf+Ti) for a Nb—16Si alloy base at 1200° C. and 210 MPa. FIG. 6 is a plot of creep rate versus Nb:(Hf+Ti) for a Nb—16Si alloy base at 1200° C. and 280 MPa.

While various embodiments are described herein, it will be appreciated from the specification that various combinations of elements, variations or improvements therein may be made by those skilled in the art, and are within the scope of the invention.

What is claimed is:

1. A niobium-based silicide composite exhibiting creep resistance at temperatures equal to or greater than 1150° C., the niobium-based silicide composite comprising:

at least silicon (Si), hafnium (Hf), titanium (Ti), niobium (Nb), and tin (Sn), wherein a concentration ratio of Nb:(Hf+Ti) is equal to or greater than about 1.4 and the niobium-based silicide composite exhibits a creep rate less than about $5\times10^{-8}s^{-1}$ at temperatures up to about 1200° C. and at a stress of about 200 MPa.

2. The composite according to claim 1, wherein the niobium-based silicide composite comprises a multiphase niobium and silicide material.

3. The composite according to claim 1, wherein the niobium-based silicide composite further comprises, in atomic percent, about up to about 25% titanium, silicon in a range from about 10 to about 22%, hafnium (Hf) in a range from about 2% to about 8%, tin (Sn) in a range from about 0.2% to about 5%, and a balance niobium.

4. The composite according to claim 3, the niobium-based silicide composite further comprising, in atomic percent, up to about 10% tantalum (Ta), up to about 10% germanium (Ge), up to about 6% iron (Fe), up to about 8% boron (B), up to about 3% molybdenum (Mo), up to about 5% aluminum (Al), and one of chromium (Cr) up to about 15% and tungsten (W) up to about 5%.

5. The composite according to claim 4, wherein the amount of hafnium is, in atomic percent, about 4%.

6. The composite according to claim 4, wherein chromium and tungsten are provided.

7. The composite according to claim 1, wherein a concentration ratio Nb:(Hf+Ti) is in a range from about 1.4 to about 2.5.

8. The composite according to claim 1, the composite comprising, in atomic percent, 7.5% hafnium (Hf), 16% silicon (Si), 21% titanium (Ti), and a balance niobium (Nb).

9. The composite according to claim 1, the composite comprising, in atomic percent, 8% hafnium (Hf), 16% silicon (Si), 21% titanium (Ti), and a balance niobium (Nb).

10. The composite according to claim 1, the composite further comprising molybdenum (Mo), the composite comprising, in atomic percent, 3% molybdenum (Mo), 8% hafnium (Hf), 16% silicon (Si), 25% titanium (Ti), and a balance niobium (Nb).

11. The composite according to claim 1, the composite further comprising molybdenum (Mo), the composite comprising, in atomic percent, 9% molybdenum (Mo), 8% hafnium (Hf), 16% silicon (Si), 25% titanium (Ti), and a balance niobium (Nb).

12. A turbine component comprising the composite according to claim 1.

13. A turbine comprising the turbine component according to claim 12.

14. A method of forming a niobium-based silicide composite, the composite exhibiting creep resistance, the method of forming the composite comprising:

providing, in atomic percent, up to about 10% tantalum, up to about 10% geranium, tin in a range from about 0.2% to about 5%, up to about 6% iron, up to about 8% boron, up to about 3% molybdenum, up to about 5% aluminum, and one of up to about 15% chromium and up to about 5% tungsten, a balance of niobium, wherein a ratio of Nb:(Hf+Ti) is equal to or greater than about 1.4.

15. The method according to claim 14, wherein the step of providing comprises providing, in atomic percent, up to about 25% titanium, silicon in a range form about 10% to about 22%, hafnium in a range from about 2% to about 8%, and a balance of niobium.

16. The method according to claim 14, wherein the amount of hafnium is about 4% atomic.

17. The method according to claim 14; wherein chromium and tungsten are provided.

18. A turbine component comprising, in atomic percent, 7.5% hafnium (Hf), 16% silicon (Si), 21% titanium (Ti), tin (Sn) in a range from about 0.2% to about 5%, and a balance niobium (Nb).

19. A turbine component comprising, in atomic percent, 8% hafnium (Hf), 16% silicon (Si), 21% titanium (Ti), tin (Sn) in a range from about 0.2% to about 5%, and a balance niobium (Nb).

20. A turbine component comprising, in atomic percent, 3% molybdenum (Mo), 8% hafnium (Hf), 16% silicon (Si), 25% titanium (Ti), tin (Sn) in a range from about 0.2% to about 5%, and a balance niobium (Nb).

21. A turbine component comprising, in atomic percent, 9% molybdenum (Mo), 8% hafnium (Hf), 16% silicon (Si), 25% titanium (Ti), tin (Sn) in a range from about 0.2% to about 5%, and a balance niobium (Nb).

22. A niobium-based silicide composite exhibiting creep resistance at temperatures equal to or greater than 1150° C., the niobium-based silicide composite, in atomic percent, comprising:

up to about 25% titanium, silicon in a range from about 10 to about 22%, hafnium (Hf) in a range from about 2% to about 8%, up to about 10% tantalum (Ta), up to about 10% germanium (Ge), tin (Sn) in a range from about 0.2% to about 5%,up to about 6% iron (Fe), up to about 8% boron (B), up to about 9% molybdenum (Mo), up to about 5% aluminum (Al), and one of chromium (Cr) up to about 15% and tungsten (W) up to about 5%, and a balance niobium.

23. The composite according to claim 22, wherein the niobium-based silicide composite comprises a multiphase niobium and silicide material.

24. The composite according to claim 22, wherein a concentration ratio of Nb:(Hf+Ti) is equal to or greater than about 1.4 and the niobium-based silicide composite exhibits a creep rate less than about $5\times10^{-8}s^{-1}$ at temperatures up to about 1200° C. and at a stress of about 200 MPa.

25. The composite according to claim 22, wherein the amount of hafnium is, in atomic percent, about 4%.

26. The composite according to claim 22, wherein chromium and tungsten are provided.

27. The composite according to claim 22, wherein a concentration ratio Nb:(Hf+Ti) is in a range from about 1.4 to about 2.5.

28. The composite according to claim 22, the composite comprising, in atomic percent, 7.5% hafnium (Hf), 16% silicon (Si), 21% titanium (Ti), and a balance niobium (Nb).

29. The composite according to claim 22, the composite comprising, in atomic percent, 8% hafnium (Hf), 16% silicon (Si), 21% titanium (Ti), and a balance niobium (Nb).

30. The composite according to claim 22, the composite further comprising molybdenum (Mo), the composite comprising, in atomic percent, 3% molybdenum (Mo), 8% hafnium (Hf), 16% silicon (Si), 25% titanium (Ti), and a balance niobium (Nb).

31. The composite according to claim 22, the composite further comprising molybdenum (Mo), the composite comprising, in atomic percent, 9% molybdenum (Mo), 8% hafnium (Hf), 16% silicon (Si), 25% titanium (Ti), and a balance niobium (Nb).

32. A turbine component comprising the composite according to claim 22.

33. A turbine comprising the turbine component according to claim 32.

* * * * *